United States Patent [19]

Boring et al.

[11] 4,342,408

[45] Aug. 3, 1982

[54] POSITIVE SEAL SPOUT

[75] Inventors: David E. Boring, New Oxford; Larry T. Quibell, Spring Grove, both of Pa.

[73] Assignee: Sonoco Products Company, Hartsville, S.C.

[21] Appl. No.: 169,410

[22] Filed: Jul. 16, 1980

[51] Int. Cl.[3] ..... B65D 5/72

[52] U.S. Cl. ..... 222/566; 220/378; 220/81 R

[58] Field of Search ..... 222/566, 567, 569, 570, 222/574, 326, 327; 277/205; 220/85 SP, 378, 81 R

[56] References Cited

U.S. PATENT DOCUMENTS 2,981,449 4/1961 Perkins ..... 222/569 X 3,658,213 4/1972 Plumer ..... 222/326

FOREIGN PATENT DOCUMENTS 597021 4/1960 Canada ..... 222/570

*Primary Examiner*—Allen N. Knowles

*Attorney, Agent, or Firm*—Dennison, Meserole, Pollack & Scheiner

[57] ABSTRACT

A self-sealing spout for a caulking cartridge or the like wherein the discharge tube of the spout extends through a central aperture in an end panel of the cartridge. The spout includes an enlarged annular base integral with the inner end of the discharge tube and engageable with the inner surface of the end panel about the central tube-receiving aperture. The base includes a flexible sealing lip defined peripherally thereabout by an annular groove, said sealing lip being retained in flexed sealed engagement with an annular inclined wall defined in the end panel. The spout is secured to the end panel by a locking of the flanged periphery of the end panel aperture within a peripheral groove about the discharge tube immediately outward of the base.

6 Claims, 4 Drawing Figures

POSITIVE SEAL SPOUT

BACKGROUND OF THE INVENTION

The invention generally relates to dispensing cartridges for caulking compound and the like, and is more particularly concerned with the discharge spout for such a cartridge and the relationship thereof to the cartridge and cap.

Caulking cartridges commonly include elongated tubular bodies, usually of spirally wound cardboard, and opposed end caps or panels. The cap at the dispensing end of the cartridge is normally formed of sheet metal, peripherally seamed to the end of the tubular body, and provided with a central aperture therethrough about which or through which the discharge spout is positioned.

The conventional spout is formed of an appropriate plastic which has some degree of flexibility and can be selectively severed for both an opening of the spout and a configuring of the discharge port.

A significant area of concern to which the present invention is directed involves the effectiveness of the sealing of the plastic spout to the metal end cap. A positive seal at this point is essential in order to avoid leakage of air and/or moisture through the joint between the spout and cap which could, and in fact frequently does, cause premature curing of some caulk materials, thus making it difficult or impossible to properly dispense or use the material. In one commercially available cartridge, a solution is proposed wherein the spout is provided with a flat disc-like base which directly abuts the planar undersurface of a metal end cap about the spoutreceiving aperture and may have a sealing compound therebetween.

SUMMARY OF THE INVENTION

It is a primary object of the present invention to provide for a positive seal between the discharge spout and the end cap of a caulking cartridge or the like. In furtherance of this object, the present invention proposes a plastic spout incorporating an enlarged self-sealing base which is so configured as to cooperatively lock to and intimately engage the end cap, peripherally about the central aperture through which the spout passes, in a manner which effectively excludes moisture vapor and air from the interior of the cartridge.

In achieving the desired seal, the sealing base of the spout is specifically configured to cooperate with the configuration of the end cap itself to achieve an intimate engagement therebetween which engagement is enhanced by the normally experienced pressure differential developed between the interior and exterior of the cartridge during filling, shortly thereafter, and later during usage. With regard to this pressure differential, during the normal filling operation, positive internal pressure is developed upon insertion of the plunger. In the case of hot filled materials, a subsequent negative internal pressure usually develops as the fill material cools and shrinks. If the seal between the spout and the end cap fails, ambient air (and moisture vapor) will be drawn into the cartridge and cause premature curing of some caulk compounds.

Ideally, and what is sought by the present invention, is a seal between the spout and end cap which will remain intact until the cartridge is used, and one which will maintain its integrity, particularly under negative pressure conditions. Basically, the spout comprises an elongated tubular discharge tube or tip and a disc-like enlarged base integrally formed about one end of the discharge tube. The base includes an annular flexible sealing lip which is defined by an annular groove in the upper or outer face of the base. The spout is completed by a peripheral recess or groove formed about the discharge tube immediately adjacent the base.

The metal end cap, with which the spout intimately engages for a positive sealing relationship, includes a discharge tube receiving central aperture therethrough surrounded by an upturned flange. Outward from the central aperture, the cap is provided with an annular step or offset which defines, on the interior face thereof, a sloped or upwardly converging annular wall.

The assembled relationship between the spout and the cap involves a projecting of the discharge tube through the aperture, from the undersurface of the cap, until the upper surface of the base engages against the undersurface of the cap, at which point the upturned flange about the cap aperture snaps into engagement within the peripheral groove in the tube. Also at this point, the annular lip of the base has engaged the end cap offset wall and flexed radially inwardly, toward the annular groove which defines the lip, to provide a positive intimate seal. Any increase in internal pressure in the cartridge will merely enhance this seal. The locking of the cap flange within the peripheral groove about the lower or inner end of the tube will normally not avoid a tendency for an inward leaking of air or moisture to occur in this area due to small edge fissures generally present in the cap flange. However, should any inward leakage occur at this point, an increase in pressure in the lip defining groove will force the lip into more intimate engagement with the surrounding sloped wall.

Additional objects and advantages which reside in the details of construction and operation of the invention will subsequently become apparent as the invention is more fully hereinafter described and claimed.

DESCRIPTION OF THE PREFERRED EMBODIMENT

Figure 1:
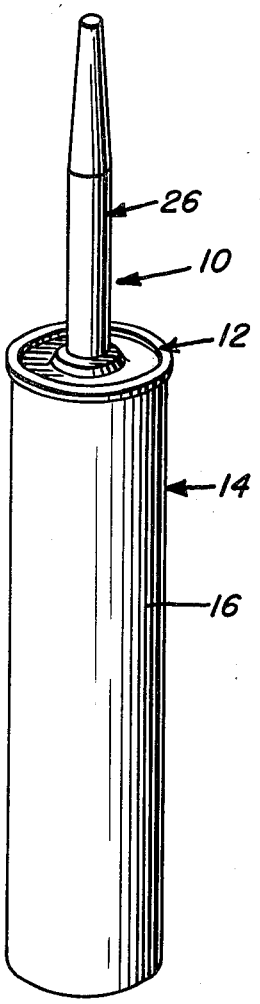
FIG. 1 is a perspective view of a caulking tube or the like incorporating the features of the present invention.
Figure 2:
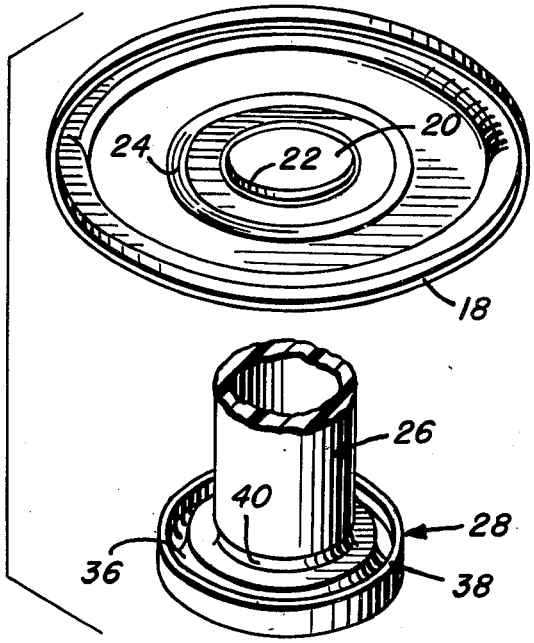
FIG. 2 is an exploded perspective view of the cap and the base portion of the self-sealing discharge spout.
Figure 3:
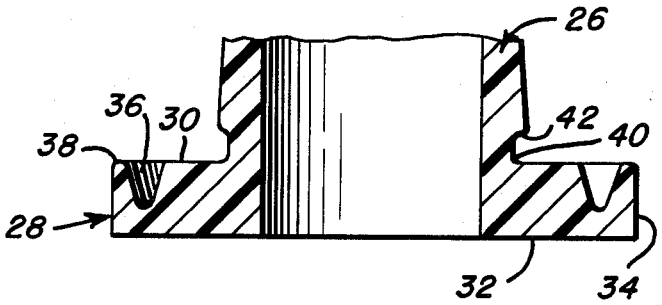
FIG. 3 is an enlarged cross-sectional view through the base portion of the spout.

Referring now more specifically to the drawings, reference numeral 10 is used to designate the positive sealing discharge spout comprising the present invention. This spout is particularly adapted for cooperative engagement with the end cap or panel 12 of a conventional caulking cartridge or the like 14. While reference is made primarily to caulking cartridges, it will be appreciated that the spout and spoutcap combination are equally adaptable for use on dispensing cartridges for a wide range of flowable or viscous materials, including adhesives, sealants, and the like.

Basically, the cartridge 14 includes an elongated tubular paperboard or plastic body 16 with the dispensing spout 10 and associated cap 12 mounted at one end and with the other end normally adapted to receive a pistonlike plunger, the telescopic inward controlled movement of which effects the dispensing of the material through the spout.

As the discharge spout and end cap are normally separately formed, with the spout conventionally of plastic and the end cap of sheet metal, difficulties arise in effecting a positive seal therebetween. This is a significant problem in view of the pressure differentials which frequently exist between the interior of the cartridge and the exterior thereof. Such pressure differentials may involve a lower or negative interior pressure resulting from a shrinkage of the material within the cartridge. Alternatively, an increased internal pressure will be developed during the dispensing of the material. The spout, and spout and cap combination of the present invention, in an effective and structurally unique manner, provides for a positive seal at the juncture between the spout and the cap.

Turning first to the cap 12, the cap is preferably formed of sheet metal with the peripheral edge portion 18 thereof adapted to be crimp-locked or seamed in a fluid-tight manner to the upper end of the tubular body 16 of the cartridge 14.

A central spout receiving aperture or opening 20 is provided through the cap 12 with the opening being surrounded by an outwardly directed peripheral flange 22 projecting perpendicularly from the upper or outer surface of the cap 12.

The cap 12 is completed by a sloping annular offset in the main body thereof surrounding the central opening 20 in radially outwardly spaced relation thereto. This offset defines, on the interior of the cap 12, an upwardly or outwardly sloped wall 24, the wall 24 being of an annular upwardly or outwardly converging configuration, defining in effect a frusto-conical shape.

The discharge spout 10, which may be made of any appropriate synthetic polymer of suitable molecular weight and density, includes an elongated discharge tube 26 having a generally tapered and sealed outer end portion which is adapted to be selectively severed or cut open to define the discharge port. An enlarged annular base 28 is integrally formed with and about the inner end of the discharge tube 26.

The base 28 includes parallel top and bottom or outer and inner surfaces 30 and 32, and a flat perpendicular outer peripheral edge 34. An annular groove 36, of generally rounded V-shaped configuration, is provided in the top surface 30 of the base 28 in slightly inwardly spaced relation to the outer peripheral edge 34 so as to define a thin sealing lip 38 which, due to the inherent nature of the plastic material used, is resiliently flexible.

The spout 10 is completed by the provision of an annular recess 40 peripherally about the lower end of the tube 26, this recess 40 extending upwardly from the upper surface 30 of the base 28 to a height substantially equal to that of the cap flange or collar 22. The upper edge 42 of the recess 40 slopes upwardly and radially outwardly at approximately 30°.

The diameter of the discharge tube 26, taken on a section through the annular recess 40, is equal to that of the central cap opening 20, the diameter of the tube 26 immediately above the recess 40, and in fact for some distance therealong, is greater than that of the cap hole 20. In this manner, a snaplocking of the spout 10 to the cap 12 can be simply and effectively achieved. Basically, the spout tube 26 is introduced through the cap opening 20 from the bottom of the cap and forced therethrough until such time as the cap flange 22 seats within the spout recess 40. The inherently flexible nature of the material of the spout tube 26 allows for a sufficient compression of the tube for movement thereof through the relatively smaller cap opening 20 with the sloping upper edge 42 of the recess 40 facilitating the final movement of the cap flange 22 into the recess. Once seated in the recess, withdrawal of the spout tube is precluded, both by the relatively sharply angled upper edge of the recess and the sharp upper edge of the upturned flange 22. In order to provide for a smooth finished appearance at the juncture between the tube 26 and the cap flange 22, the recess 40 will preferably be of a depth substantially equal to the thickness of the flange.

Figure 4:
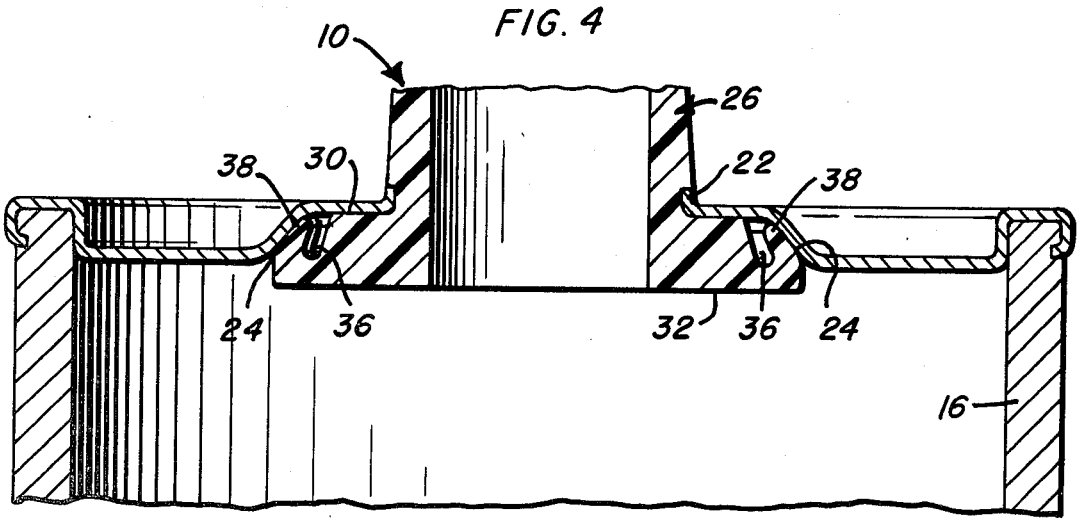
FIG. 4 is a cross-sectional detail through the discharge end of the cartridge, illustrating the relationship between the spout and end cap.

As will be best appreciated from FIG. 4, the diameter of the base 28 is such so as to, in the final assembly, align the upwardly directed peripheral lip 38 with the inclined annular wall 24 toward the bottom or wider periphery thereof whereby upon an introduction of the spout tube 26 into seated engagement within the cap opening 20, the peripheral lip 38 of the base 28 will engage the annular wall 24 and inwardly flex into positive sealing engagement therewith completely about the periphery of the base 28. When mounted in this manner, physical non-destructive disassembly is not possible. Further, the development of a pressure differential between the interior of the cartridge and the exterior thereof would, rather than encourage leakage between the spout and cap, merely enhance the seal therebetween. For example, should internal pressure within the cartridge body be greater than ambient pressure, the increased pressure, bearing against the enlarged inner planar surface 32 of the spout base 28, will increase the sealing pressure of the flexed peripheral lip 38 with the inclined wall 24. By the same token, should an internal low pressure develop within the cartridge body, and in the event such an internal pressure differential tends to cause an inward migration of air or moisture about the spout tube between the tube and the hole flange 22, and along the upper surface 30 of the spout base 28, the air and/or moisture will be trapped within the chamber defined by the peripheral groove 36. Any increase in pressure within this groove defined chamber will bear outwardly against the inwardly flexed lip 38 and tend to bring this lip 38 into even more intimate contact with the inclined surrounding wall 24 to thereby enhance the sealing engagement therebetween. The inwardly flexed or turned arrangement of the lip 38 effectively prevents any possibility of the lip reversing itself and turning downward into the cartridge body such as could occur were a planar lip merely positioned in underlying relation to the inner surface of the cap.

For purposes of illustration, assuming a conventional cartridge body of approximately two inches in diameter, the spout base will have a diameter on the order of 1.075 inches. The diameter of the annular lip defining groove 36, along the center line thereof, will be 0.956 inches. The depth of the groove, or the height of the formed lip, will be on the order of 0.097 inches with the height of the base itself being 0.128 inches. The side walls of the groove will diverge at approximately 30° relative to each other.

From the foregoing, it will be appreciated that a unique system has been devised for effectively sealing a plastic discharge spout to the metal end cap of a caulking cartridge or the like. This has been effected through the provision of a specifically configured integral base on the spout itself with the base, through a flexible peripheral lip thereon, cooperating with the end cap in achieving the desired seal. The cooperative relationship between the spout base and the end cap is such as to insure a positive sealing either in conjunction with the commonly provided sealing compound bead or without the use of such a sealing bead, or other fastener means. In this regard, it is to be noted that the use heretofor of a sealing compound has been less than satisfactory in that the flexing of the spout base would tend to break or disrupt the sealing compound bead. This is not a problem with the flexible sealing lip of the base of the present invention and the intimate contact achieved thereby, even when subjected to a degree of flexing.

The foregoing is considered illustrative of the principles of the invention. Other embodiments and modifications, falling within the scope of the invention as claimed, may be resorted to.

We claim:

1. For use in a caulking cartridge or the like, a self-sealing spout, said spout comprising an elongated material discharge tube having opposed inner and outer ends, said spout further including a generally planar enlarged sealing base integrally formed with the inner end of the tube peripherally thereabout, said base including a free peripheral edge, and inner and outer faces, a groove defined in the outer face of the base completely thereabout and in inwardly spaced relation to the free peripheral edge of the base, said base, between the peripheral edge and the groove, defining a continuous flexible lip, said lip being laterally directed relative to the plane of the base.

2. The spout of claim 1 including a retaining recess formed in the discharge tube peripherally thereabout and immediately outward of the sealing base.

3. The spout of claim 2 wherein said material discharge tube is cylindrical and said sealing base is annular.

4. In combination with a generally planar end cap, for a caulking cartridge or the like, wherein said end cap has inner and outer faces, a spout receiving opening defined centrally therethrough, and an offset spaced outward from said opening completely thereabout and defining, on the inner face of the cap, a centrally converging wall; a self-sealing spout, said spout comprising an elongated material discharge tube having opposed inner and outer ends, said tube being received through said cap opening, a generally planar enlarged sealing base integrally formed with the inner end of the tube peripherally thereabout, said base engaging said cap within said wall, said base having a free peripheral edge and inner and outer faces, a continuous groove being defined in the outer face of said base inwardly from the peripheral edge thereof, said base, between the groove and the peripheral edge, defining a continuous flexible lip peripherally thereabout, said lip being laterally directed relative to the plane of the base and engaged with said wall, the engagement of the lip with the wall effecting an inward flexing of the lip peripherally about the base.

5. The assembly of claim 4 wherein the lip forming groove defines a continuous chamber upon engagement of the lip with the cap wall.

6. The assembly of claim 5 including a recess defined peripherally about the discharge tube immediately outward of the base, said cap opening including an outwardly directed flange peripherally thereabout, said flange being received with said tube recess upon engagement of the outer face of the base against the inner face of the cap with the sealing lip engaged against the wall of the cap and deflected into a converging configuration.

* * * * *